US006942558B2

(12) United States Patent
Wuensch

(10) Patent No.: US 6,942,558 B2
(45) Date of Patent: Sep. 13, 2005

(54) HAND-HELD MACHINE TOOL

(75) Inventor: Steffen Wuensch, Holzgerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 31 days.

(21) Appl. No.: 10/344,602

(22) PCT Filed: May 17, 2002

(86) PCT No.: PCT/DE02/01791

§ 371 (c)(1),
(2), (4) Date: Feb. 13, 2003

(87) PCT Pub. No.: WO03/011519

PCT Pub. Date: Feb. 13, 2003

(65) Prior Publication Data

US 2004/0011545 A1 Jan. 22, 2004

(30) Foreign Application Priority Data

Jul. 19, 2001 (DE) ..... 101 352 514

(51) Int. Cl.[7] ..... B24B 23/03
(52) U.S. Cl. ..... 451/357; 451/342
(58) Field of Search ..... 451/357, 359, 451/344, 353

(56) References Cited

U.S. PATENT DOCUMENTS

| | | | | | |
|---|---|---|---|---|---|
| 2,751,725 | A | * | 6/1956 | Champayne | 451/357 |
| 3,555,743 | A | * | 1/1971 | Geiger | 451/357 |
| 3,943,669 | A | | 3/1976 | Stroezel | |
| 4,729,195 | A | * | 3/1988 | Berger | 451/357 |
| 5,317,838 | A | * | 6/1994 | Bourner | 451/294 |
| 5,496,207 | A | * | 3/1996 | Hornung et al. | 451/357 |
| 5,580,302 | A | * | 12/1996 | Howard et al. | 451/357 |

FOREIGN PATENT DOCUMENTS

| | | |
|---|---|---|
| DE | 198 29 190 A | 1/2000 |
| DE | 198 52 137 A | 5/2000 |

* cited by examiner

*Primary Examiner*—Robert A. Rose
(74) *Attorney, Agent, or Firm*—Michael J. Striker

(57) ABSTRACT

The invention is based on a hand power tool that comprises a motor (12)—with a motor shaft 14—located in a housing (10), which said motor shaft is supported via a shaft bearing (18) located on a side closest to a backing pad (16) and that is interconnected in torsion-resistant fashion with an eccentric sleeve (22) in a seat (20). It is proposed that the eccentric sleeve (22) projects in the axial direction (56) at least partially into the shaft bearing (18), and at least part of the axial space of the shaft bearing (18) is used to form a drive connection with the eccentric sleeve (22).

7 Claims, 2 Drawing Sheets

HAND-HELD MACHINE TOOL

BACKGROUND OF THE INVENTION

The invention is based on a hand power tool according to the preamble of claim 1.

Orbit sanders are known that comprise an electric motor—located in a housing—with an armature shaft pointing in the direction of a backing pad. The armature shaft is supported in the housing of the orbit sander via an armature ball bearing on the side closest to the backing pad.

On its end closest to the backing pad, the armature shaft is pressed into a seat of an eccentric sleeve and is interconnected with it in torsion-resistant fashion. A backing pad ball bearing is secured on the eccentric sleeve on the side of the eccentric sleeve closest to the backing pad, via which said ball bearing the backing pad is supported on the eccentric sleeve. Moreover, a fan wheel of a fan is secured on the eccentric sleeve in the region of the seat of the armature shaft.

ADVANTAGES OF THE INVENTION

The invention is based on a hand power tool that comprises a motor—with a motor shaft—located in a housing, which said motor shaft is supported via a shaft bearing located on a side closest to a backing pad and that is interconnected in torsion-resistant fashion with an eccentric sleeve in a seat.

It is proposed that the eccentric sleeve projects in the axial direction at least partially into the shaft bearing, and at least part of—and preferably all of—the axial space of the shaft bearing is used to form a drive connection with the eccentric sleeve. Axial space can be spared and, therefore, an advantageously low center of gravity and a particularly maneuverable hand power tool can be obtained. This is particularly effective with hand power tools that are guided with one hand via a handle integrally molded on the housing.

The means of attaining the object, according to the invention, can be used with various drive systems appearing reasonable to one skilled in the art, e.g., with pneumatically driven hand power tools, etc. The means of attaining the object, according to the invention, is used particularly effectively with electrically driven hand power tools having an electric motor. Electric motors are usually larger and heavier than pneumatic motors, so saving axial space and the obtainable low center of gravity have a particularly advantageous effect with electrically driven hand power tools.

Moreover, by means of the object attained according to the invention, a small distance between the shaft bearing and a backing pad bearing interconnected with the eccentric sleeve can be obtained, i.e., advantageously a distance of between 5 mm and 15 mm. As a result of the small distance, a favorable variance of forces is obtainable, and vibrations can be prevented. The backing pad bearing can be located in the eccentric sleeve or, advantageously, on the eccentric sleeve.

If the shaft bearing is supported in a housing part via a flange formed by a separate component and radially surrounding said shaft bearing, simple assembly of the hand power tool can be obtained. The shaft bearing and the flange can be preassembled and interconnected with the housing part in the preassembled state. It is also feasible in principle, however, for the shaft bearing to be supported directly in the housing of the hand power tool and/or in a housing part in which the motor is located.

The flange can be secured in the housing part via various positive, non-positive and/or bonded connections appearing reasonable to one skilled in the art, e.g., via an adhesive connection, a screw connection, a detent connection, etc. If the flange is secured in the housing part via a compression connection, however, simple and rapid assembly can be obtained and additional fastening parts can be spared.

In a further embodiment of the invention it is proposed that the flange be secured in the housing part on the side of the shaft bearing furthest away from the backing pad, by way of which an advantageous utilization of space can be obtained.

It is further proposed that the eccentric sleeve be designed integral with a fan wheel. Additional components, assembly expenditure, space, and costs can be spared. It is also possible, however, to secure a separate fan wheel on the eccentric sleeve, e.g., to press it on.

The means of attaining the object, according to the invention, can be used in all hand power tools appearing reasonable to one skilled in the art, such as orbit sanders, oscillating sanders, multi-sanders, etc.

SUMMARY OF THE DRAWINGS

Further advantages result form the following description of the drawings. An exemplary embodiment of the invention is shown in the drawings. The drawings, the description, and the claims contain numerous features in combination. One skilled in the art will advantageously consider them individually as well and combine them into reasonable further combinations.

DESCRIPTION OF THE PREFERRED EMBODIMENTS

Figure 1:
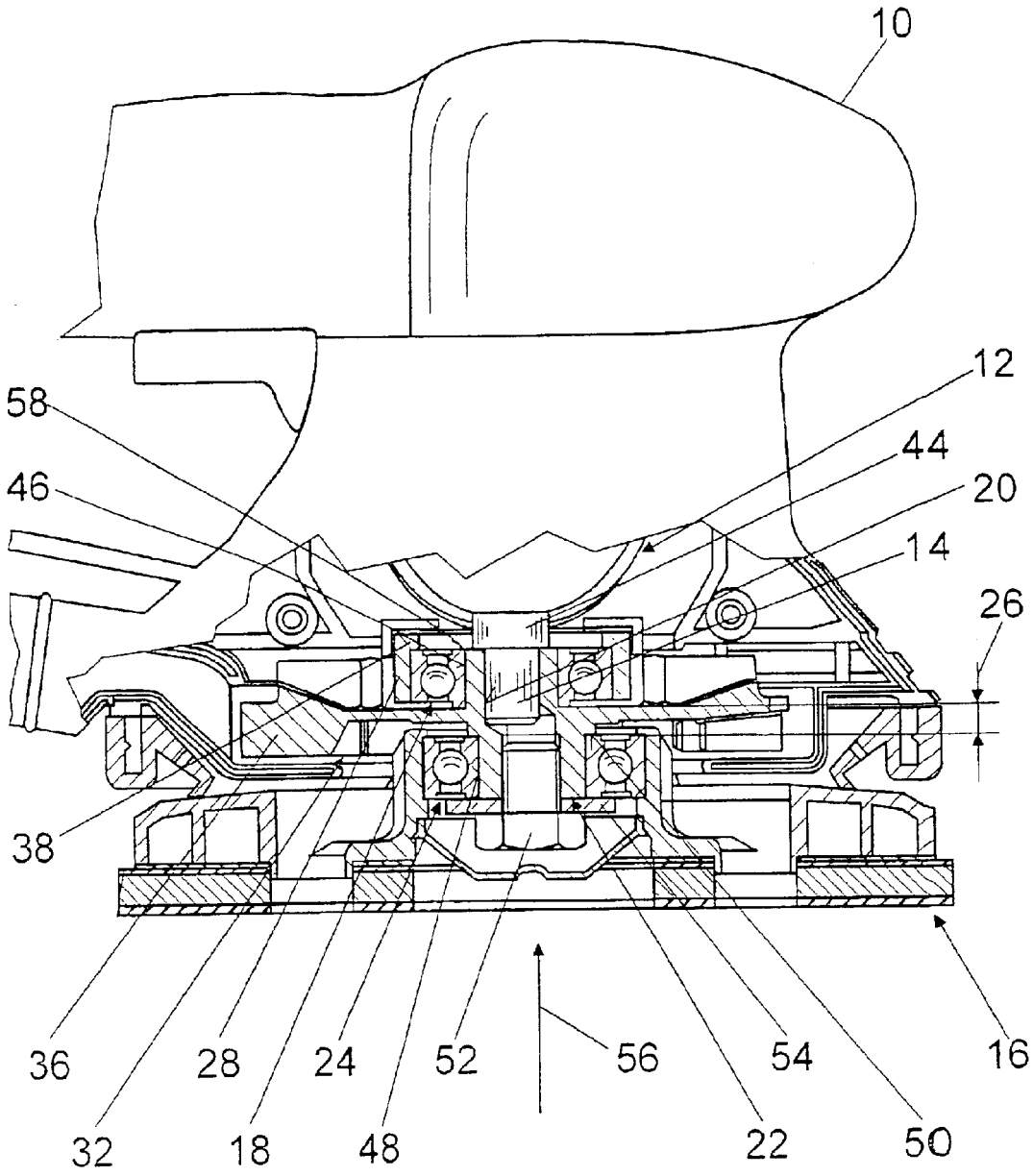
FIG. 1 is a longitudinal, partial sectional drawing through an orbit sander.

FIG. 1 is a partial sectional view through an orbit sander that comprises an electric motor 12—having an armature shaft 14—located in a housing 10. The armature shaft 14 is supported via a shaft bearing 18 located on a side closest to a backing pad 16, and it is interconnected with an eccentric sleeve 22 in torsion-resistant fashion in a seat 20. The shaft bearing 18 is formed by a ball bearing, although it could also be designed as a sliding bearing.

According to the invention, the eccentric sleeve 22 projects in the axial direction 56 into the shaft bearing 18, and/or the armature shaft 14 is supported in the shaft bearing 18 via the eccentric sleeve 22, and all of the axial space of the shaft bearing 18 is used to form a drive connection with the eccentric sleeve 22.

The shaft bearing 18 and a backing pad bearing 24—which is also designed as a ball bearing—located on the eccentric sleeve 22 are separated by an axial distance 26 of approximately 10 mm. The eccentric sleeve 22 forms a point of support 46 for the shaft bearing 18, and a point of support 48 for the backing pad bearing 24, and it is designed integral with a fan wheel 36 of a fan 32.

Figure 3:
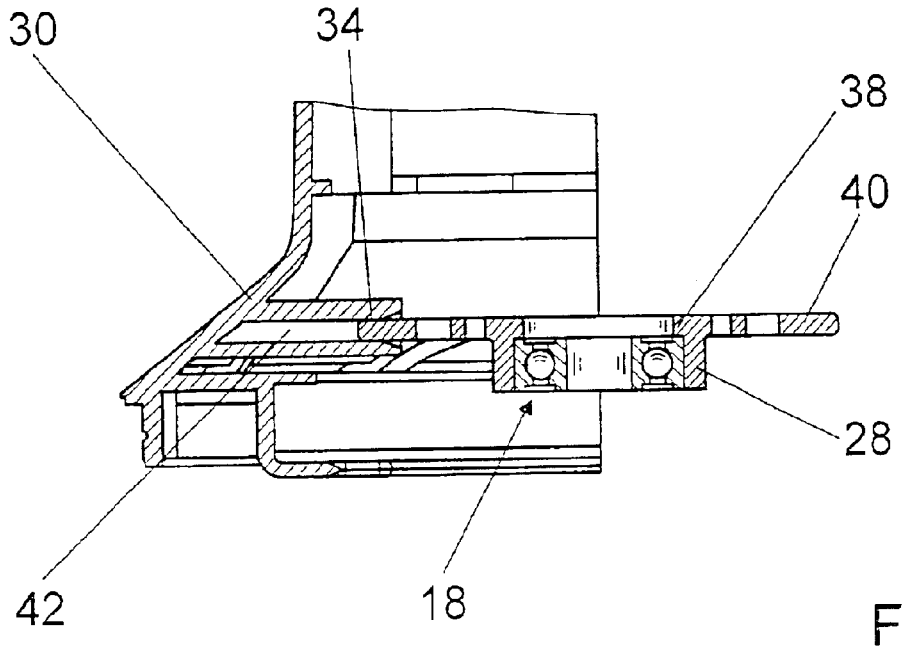
FIG. 3 is a view of the flange in FIG. 2 mounted in a housing part.

The shaft bearing 18 is supported in a housing part 30 via a flange 28 formed by a separate component and radially surrounding said shaft bearing (FIG. 3). The flange 28 is secured in the housing part 30 of the fan 32 via a compression connection 34, i.e., on the side of the shaft bearing 18 furthest away from the backing pad 16.

Figure 2:
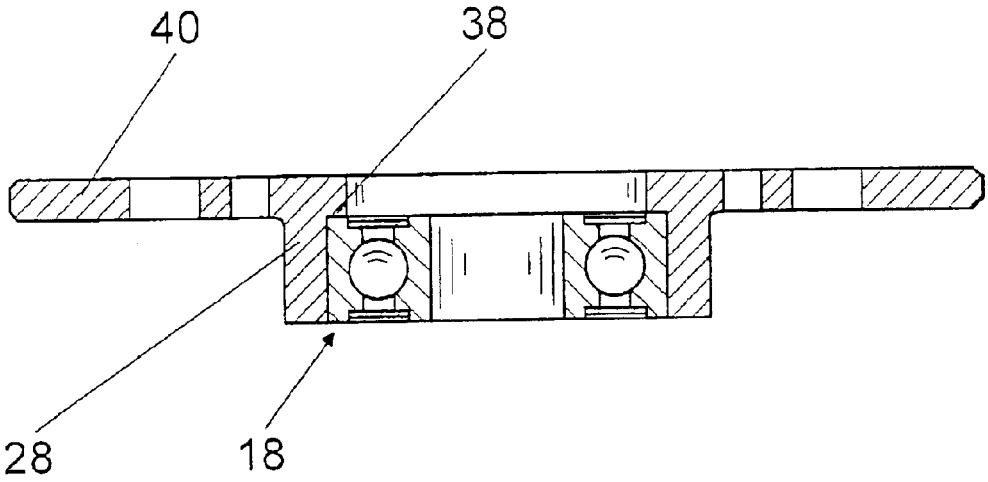
FIG. 2 is a view of shaft bearing preassembled in a flange.

During assembly, the shaft bearing 18 is pressed into the flange 28 (FIG. 2). The shaft bearing 18 comes to rest—on the side furthest away from the backing pad 16—against a collar 38 of the flange 28, and is flush with the flange 28 on the side closest to the backing pad 16.

Subsequently, the eccentric sleeve 22 is inserted in the shaft bearing 18, and the armature shaft 14 is pressed into the eccentric sleeve 22. The eccentric sleeve 22—with its end face 58 furthest away from the backing pad 16—comes to rest against a collar 44 integrally molded on the armature shaft 14.

The preassembled subassembly composed of the eccentric sleeve 22, the shaft bearing 18, the flange 28 and the electric motor 12 with its armature shaft 14 are then pressed—with an annular tray 40 integrally molded on the flange 28—into a recess 42 of the housing part 30, and/or they are installed in the housing 10 of the orbit sander, and they are thereby secured axially, radially, and against twisting.

In a next assembly step, the backing pad 16—which forms a preassembled subassembly together with the backing pad bearing 24—is pushed onto the point of support 48 of the eccentric sleeve 22, whereby the backing pad bearing 24 comes to rest—on the side furthest from the backing pad 16—against a stop 50 integrally molded on the eccentric sleeve 22. A hexagon screw 52 is then screwed into the eccentric sleeve 22, with which the backing pad bearing 24 and the backing pad 16 are secured to the eccentric sleeve 22 via a load-bearing ring 54.

Reference Numerals

10 Housing
12 Motor
14 Motor
16 Backing pad
18 Shaft bearing
20 Seat
22 Eccentric sleeve
24 Backing pad bearing
26 Distance
28 Flange
30 Housing part
32 Fan
34 Compression connection
36 Fan wheel
38 Collar
40 Annular tray
42 Recess
44 Collar
46 Point of support
48 Point of support
50 Stop
52 Hexagon screw
54 Load-bearing ring
56 Direction
58 End face

What is claimed is:

1. A hand power tool, comprising a housing; a motor having a motor shaft and located in said housing; a backing pad; a seat provided with an eccentric sleeve; a shaft bearing supporting said motor shaft, said shaft bearing being located on a side closest to said backing pad and being interconnected in a torsion-resistant fashion with said eccentric sleeve, said eccentric sleeve projecting in an axial direction at least partially into said shaft bearing, and at least part of an axial space of said shaft bearing being used to form a drive connection with said eccentric sleeve; and a flange via which said shaft bearing is supported in a housing part, said flange being formed by a separate component and radially surrounding said shaft bearing, said flange being both separate from said housing and also separate from said motor, wherein said shaft bearing, said flange and said eccentric sleeve form a preassembled subassembly.

2. A hand tool as defined in claim 1, and further comprising a backing pad bearing, said shaft bearing and said backing pad bearing being interconnected with said eccentric sleeve and being separated by an axial distance of between 5 mm and 15 mm.

3. A hand tool as defined in claim 1, and further comprising a compression connection via which said flange is secured in said housing part.

4. A hand tool as defined in claim 1, wherein said flange is secured in said housing part on a side of said shaft beating farthest away from said backing pad.

5. A hand tool as defined in claim 1, wherein said shaft bearing is connected via a pressing connection with said flange.

6. A hand power tool, comprising a housing; a motor having a motor shaft and located in said housing; a backing pad; a seat provided with an eccentric sleeve; a shaft beating supporting said motor shaft, said shaft bearing being located on a side closest to said backing pad and being interconnected in a torsion-resistant fashion with said eccentric sleeve, said eccentric sleeve projecting in an axial direction at least partially into said shaft bearing, and at least part of an axial space of said shaft bearing being used to form a drive connection with said eccentric sleeve; and a flange via which said shaft bearing is supported in a housing part, said flange being formed by a separate component and radially surrounding said shaft bearing, said flange being both separate from said housing and also separate from said motor, wherein said eccentric sleeve extends into a backing pad bearing and is screwed near a recess of a mounting screw arranged eccentrically to said seat.

7. A hand tool as defined in claim 1, wherein said flange is pressed in a radially extending recess of said housing part.

* * * * *